US006520657B1

(12) United States Patent
DeNicola

(10) Patent No.: US 6,520,657 B1
(45) Date of Patent: Feb. 18, 2003

(54) CHEMILUMINESCENT ILLUMINATING BASE

(76) Inventor: Frank DeNicola, 54 Munko Dr., Stamford, CT (US) 06902

( * ) Notice: Subject to any disclaimer, the term of this patent is extended or adjusted under 35 U.S.C. 154(b) by 0 days.

(21) Appl. No.: 10/071,108

(22) Filed: Feb. 8, 2002

(51) Int. Cl.[7] ..... F21K 2/06
(52) U.S. Cl. ..... 362/34; 362/101
(58) Field of Search ..... 362/34, 101, 96

(56) References Cited

U.S. PATENT DOCUMENTS

| | | | | |
|---|---|---|---|---|
| 4,563,726 | A | 1/1986 | Newcomb et al. | 362/34 |
| 5,171,081 | A | 12/1992 | Pita et al. | 362/34 |
| 5,552,968 | A | 9/1996 | Ledyjensky | 362/34 |
| 5,609,409 | A | 3/1997 | Diehl | 362/101 |
| 5,671,998 | A | 9/1997 | Collett | 362/101 |
| 5,990,790 | A | 11/1999 | Lusareta | 340/571 |
| 6,062,380 | A | 5/2000 | Dorney | 206/217 |
| 6,082,866 | A | 7/2000 | Amedee | 362/34 |
| 6,213,616 | B1 | 4/2001 | Chien | 362/84 |
| 6,254,247 | B1 | 7/2001 | Carson | 362/101 |
| 6,305,817 | B1 | 10/2001 | Johnston et al. | 362/154 |
| 6,322,227 | B1 * | 11/2001 | Liu et al. | 362/34 |
| 6,371,624 | B1 * | 4/2002 | Dorney | 362/101 X |

* cited by examiner

*Primary Examiner*—Laura K. Tso
(74) *Attorney, Agent, or Firm*—St. Onge Steward Johnston & Reens LLC

(57) ABSTRACT

A product container assembly is provided to enhance to consumers the appeal of products sold in containers and for those means and/or devices to be simple, cost effective, and incorporate interaction between consumer and product. The assembly comprises a product container having a bottom surface and at least one side surface; a chemiluminescent illuminating base comprising an illuminating base portion substantially supporting the product container and having a top wall at least partially opposed to the bottom surface of the product container; a bottom wall capable of transmitting an engaging pressure; a chemiluminescent illuminating device disposed between the top and bottom walls and operative by the application of the engaging pressure; and at least one substantially upright wall connecting the top and bottom walls, and enclosing the chemiluminescent illuminating device; and being secured at the top wall of the illuminating base portion to the bottom surface of the product container. The methods of manufacture for same are also provided.

17 Claims, 2 Drawing Sheets

CHEMILUMINESCENT ILLUMINATING BASE

FIELD OF THE INVENTION

The present invention relates to a means and a method of providing illumination and interaction to a product container. More particularly, the present invention relates to an illuminating base having a selectively operable chemiluminescent illuminating device provided to a product and the method of making same.

BACKGROUND OF THE INVENTION

Distinguishing common consumer products from their like competitors in an attractive and interesting manner increases sales and consumption of the product. In doing so, marketers aim to appeal to the five senses of human beings-smell, touch, vision, hearing, and taste.

In creating consumer products; the taste, smell, and visual appeal of a product, such as a beverage, are optimized to appeal to a target market while maintaining economic viability of the product. The containers used to market the product are similarly optimized. As result, consumer products are often introduced in aggressively styled containers. For example, beverages have edgy flavors and colors.

However, once optimized such appeal oriented attributes, especially visual attributes, remain static. Consequently, consumers can quickly become inured to a product's visual appeal. Attributes that seem new and radical when introduced become commonplace. Container shapes that once were unique become part of the consumer landscape.

It is has been proposed that illumination of a product in an unusual and/or attractive manner would increase attention that yields higher sales conversions. This is especially true for products sold in containers, such as beverages. It has similarly been proposed that engaging the user in an interesting and/or rewarding interaction with the container would also yield higher sales conversions. It has further been proposed that changing the coloration of a product in response to such an interaction would further increase consumer interest.

Therefore, what is desired are means and/or devices to enhance to consumers the appeal of products sold in containers and for those means and/or devices to be simple, cost effective, and incorporate interaction between consumer and product.

Therefore, what is also desired are methods for making the same.

SUMMARY OF THE INVENTION

In accordance with one aspect of the present invention, an assembly is provided comprising a product container having a bottom surface and at least one side surface; a chemiluminescent illuminating base comprising an illuminating base portion substantially supporting the product container and having a top wall at least partially opposed to the bottom surface of the product container; a bottom wall capable of transmitting an engaging pressure; a chemiluminescent illuminating device disposed between the top and bottom walls and operative by the application of the engaging pressure; and at least one substantially upright wall connecting the top and bottom walls, and enclosing the chemiluminescent illuminating device; and being secured at the top wall of the illuminating base portion to the bottom surface of the product container.

In accordance with another aspect of the present invention, A method of manufacturing an assembly, comprising providing product container having a bottom surface and a side surface; providing a chemiluminescent illuminating base further comprising the steps of providing an illuminating base portion substantially supporting the product container and comprising the steps of providing a top wall at least partially opposed to the bottom surface of the product container; providing a bottom wall capable of transmitting an engaging pressure; disposing a chemiluminescent illuminating device between the top and bottom walls and being operative by the application of the engaging pressure; and providing at least one substantially upright wall connecting the top and bottom walls, and enclosing the chemiluminescent illuminating device; and securing the top wall of the illuminating base portion to the bottom surface of the product container.

DETAILED DESCRIPTION OF THE DRAWINGS

Figure 1:
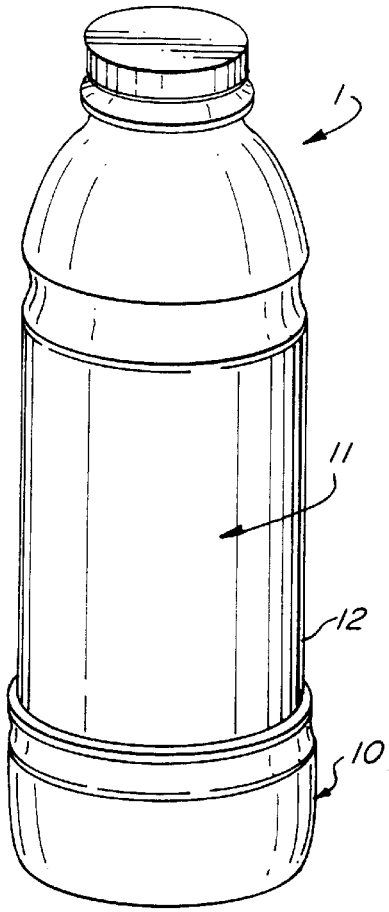
FIG. 1 is an illustration of a product container assembly including a chemiluminescent illuminating base in accordance with one preferred embodiment of the invention.

FIG. 1 is an illustration of a product container assembly including a chemiluminescent illuminating base in accordance with one preferred embodiment of the invention. A consumer has acquired product 11 in product container assembly 1 by purchase or promotional give-away. Preferably, assembly includes a translucent and/or transparent product container 12 affixed to which is chemiluminescent illuminating base 10. Chemiluminescent illuminating base 10 is capable of supporting product container 12.

Figure 2:
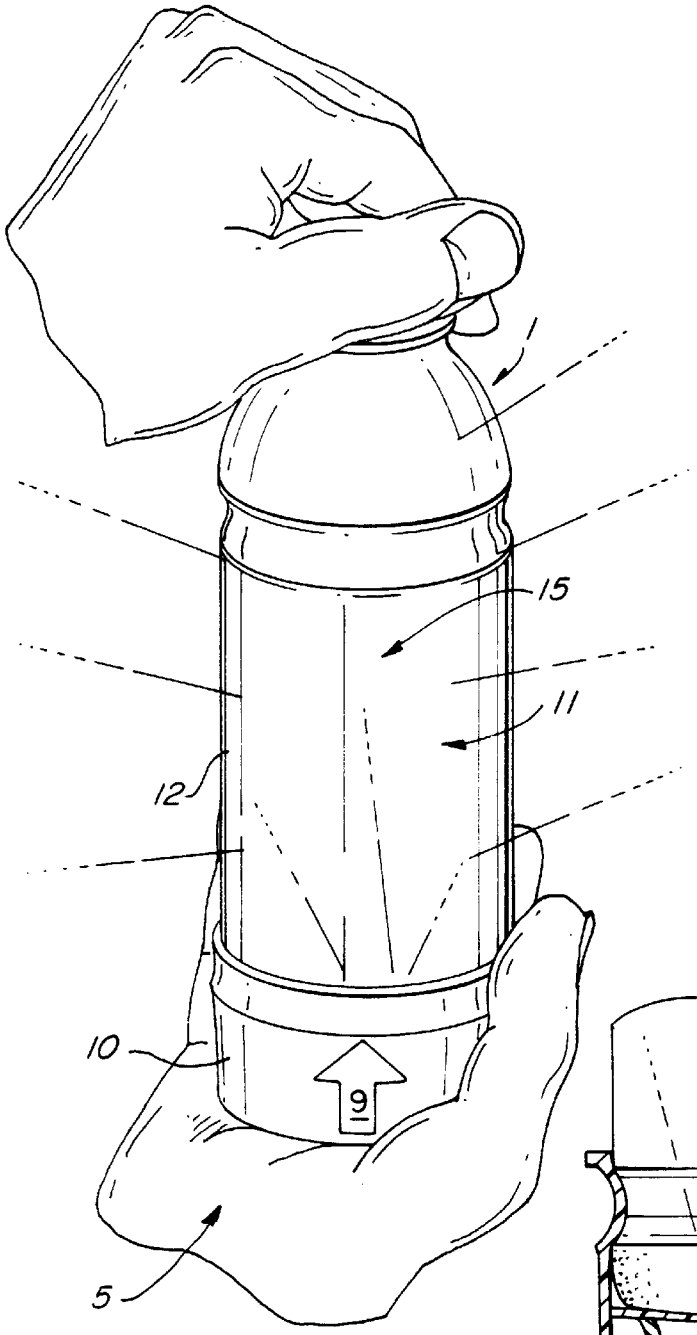
FIG. 2 is an illustration of a product container assembly including a chemiluminescent illuminating base in accordance with one preferred embodiment of the invention.

FIG. 2 is an illustration of a product container assembly including a chemiluminescent illuminating base in accordance with one preferred embodiment of the invention. Consumer 5 engages the chemiluminescent illuminating base 10 of assembly 1 disposed on product container 12 by applying pressure 9 on the chemiluminescent illuminating base 10 creating chemiluminescent illuminating effect 15.

Figure 3:
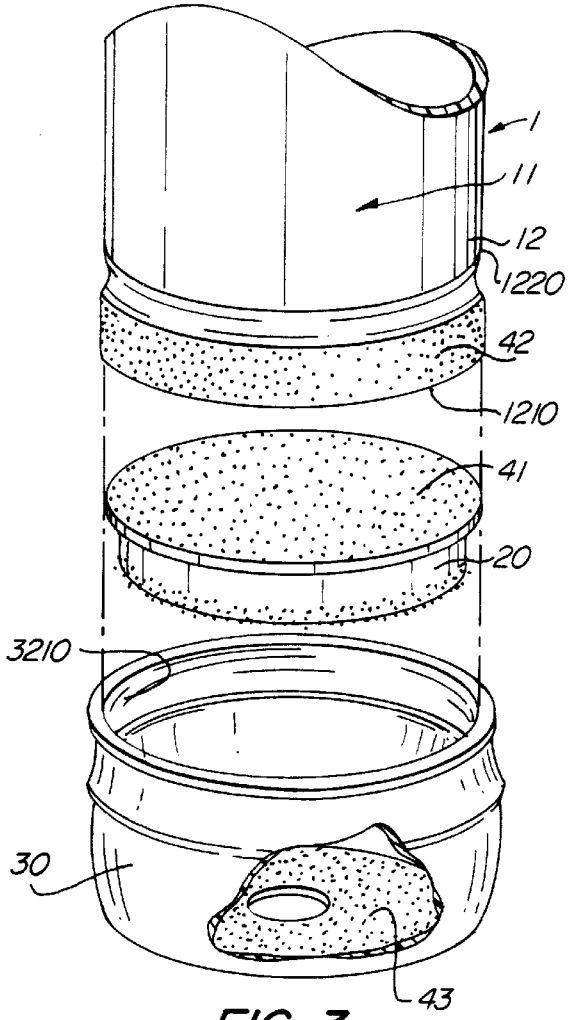
FIG. 3 is an "exploded" view of a partial product container assembly including a chemiluminescent illuminating base in accordance with one preferred embodiment of the invention.

FIG. 3 is an "exploded" view of a partial product container assembly including a chemiluminescent illuminating base in accordance with one preferred embodiment of the invention. Product container assembly 1 includes chemiluminescent illuminating base 10 and product container 12. Chemiluminescent illuminating base 10 includes an illuminating base portion 20 and a protective holder 30.

Figure 7:
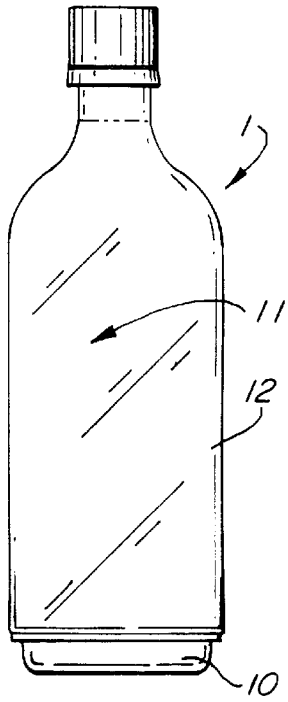
FIG. 7 is an illustration of a product container assembly including a chemiluminescent illuminating base in accordance with another preferred embodiment of the invention.

FIG. 7 is an illustration of a product container assembly including a chemiluminescent illuminating base in accordance with another preferred embodiment of the invention. Chemiluminescent base assembly 1 includes chemiluminescent illuminating base 10 and product container 12. However, chemiluminescent illuminating base 10 is not disposed with a protective holder 30.

With reference to FIG. 3, further illustrated is a section of product container 12. Preferably, illuminating base portion 20 is adjacent to container bottom surface 1210 of product container 12 and is disposed inside protective holder 30. F?referably, protective holder 30 fits over product container 12 contacting container side surface 1220.

Preferably illuminating base portion 20 and protective holder 30 are sized and/or shaped to accommodate the size and/or shape of product container 12, including the container bottom surface 1210 and container side surface 1220.

Preferably, product bottom 1210 is flat. However, it may be shaped to be convoluted, ridged, irregular, and/or any shape so desired. Thus, in one embodiment product container 12 is circular in transverse cross-section. Correspondingly, illuminating base portion 20 is circular with a diameter slightly smaller but very approximate that of product container 12. Similarly, protective holder 30 is circular with a diameter slightly larger but very approximate that of product container 12 so that protective holder 30 fits snugly over product container 12 contacting sidewall 1220.

In one embodiment, container bottom surface 1210 is furrowed. Illuminating base portion 20 is matchingly furrowed and disposed adjacent to container bottom surface 1210. In a further embodiment, container bottom surface 1210 is furrowed while Illuminating base portion 20 is substantially flat and disposed adjacent to container bottom surface 1210 only at the crowns of the furrows.

Illuminating base portion 20 and protective holder 30 may also be sized so as to be larger or smaller, or differently shaped than the product container 12. As a result, unusual and/or attractive illuminative designs may be created on the exterior surface of product container 12 and/or interior of product container 12 and/or product 11.

Figure 4:
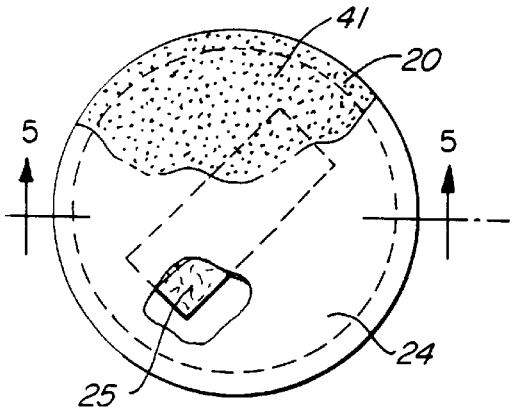
FIG. 4 is a top view of an illuminating base portion of chemiluminescent illuminating base in accordance with one preferred embodiment of the invention.

FIG. 4 is a top view of an illuminating base portion of chemiluminescent illuminating base in accordance with one preferred embodiment of the invention. illuminating base portion 20 is shown in a circular form with a marginal edge at the top wall 24 and chemiluminescent illuminating device 25 disposed within illuminating base portion 20. Illuminating base portion 20 may take a circular shape as shown or it may be any other shape convenient and/or desired.

Figure 5:
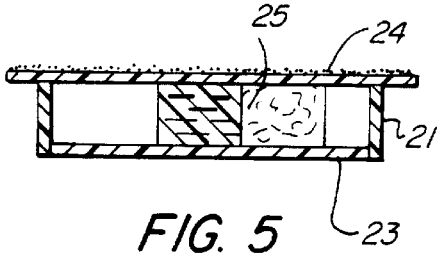
FIG. 5 is a cross-sectional illustration of an illuminating base portion of a chemiluminescent illuminating base in accordance with one preferred embodiment of the invention.

FIG. 5 is a cross-sectional illustration of an illuminating base portion of a chemiluminescent illuminating base in accordance with one preferred embodiment of the invention. Illuminating base portion 20 includes substantially upright wall 21, bottom wall 23, and top wall 24. Disposed inside illuminating base portion 20 is a chemiluminescent illuminating device 25.

Chemiluminescent illuminating means and devices, such as chemiluminescent illuminating device 25, are known in the art. Such means or devices create illumination when chemicals that are physically separated are introduced to each other creating a reaction that includes an illuminating chemiluminescent effect, such as chemiluminescent effect 15.

Figure 6:
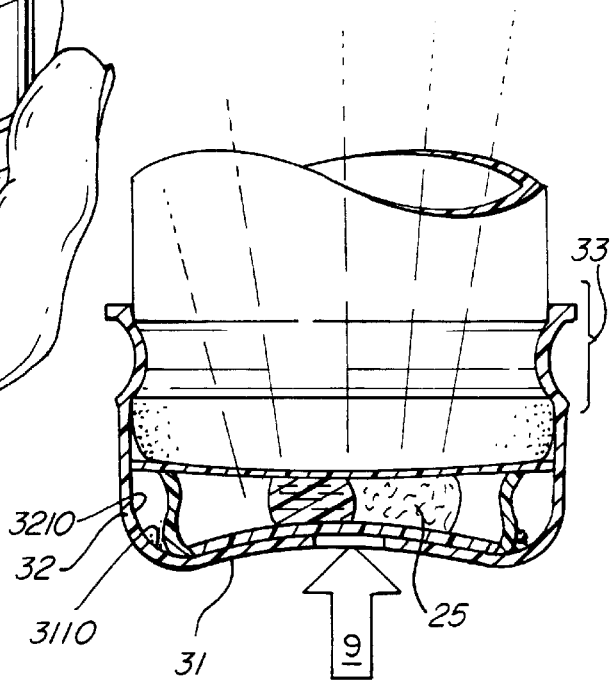
FIG. 6 is a cross-section of an illuminating base portion of a chemiluminescent illuminating base in accordance with one preferred embodiment of the invention.

FIG. 6 is a cross-section of an illuminating base portion of a chemiluminescent illuminating base in accordance with one preferred embodiment of the invention. Preferably, the illuminating base portion 20, shown here disposed within protective holder 30, is made of material that is sufficiently flexible that when a consumer 5 engages chemiluminescent illuminating base 10 by applying pressure 9, for example by pressing with a digit on illuminating base portion 20 or by applying pressure on protective holder 30, the chemicals become miscible and react because the housing of one or more chemicals breaks. The reaction creates chemiluminescent illuminating effect 15.

With reference to FIG. 5; preferably, illuminating base portion 20 is sealed so that the chemicals of chemiluminescent illuminating device 25 do not leak from chemiluminescent illuminating base 10. Preferably illuminating base portion 20 has a small cross-sectional area when compared to its upright area so that illuminating base portion 20 is unobtrusive in chemiluminescent illuminating base assembly 10.

Walls 21, 23, and 24 in the illuminating base portion 20 may be transparent and/or translucent so as to permit the illumination of the chemiluminescent effect to exit the illuminating base portion 20. Walls 21 and 23 may also be opaque and only top wall 24 or a portion of top wall 24 transparent and/or translucent. Top wall 24 may also be partially opaque and partially transparent and/or translucent so as to create a desired design that is projected into product container 12 and/or product 11 when chemiluminescent illuminating base 10 is engaged by consumer 5.

With reference to FIG. 4, top wall 24 may be disposed with a marginal edge to accommodate a support when placing illuminating base portion 20 in a protective holder 30.

With reference to FIG. 6, protective holder 30 includes a bottom wall 31 having an interior bottom wall side 3110 and an opening 3150, substantially upright wall 32 having an interior upright wall side 3210 and exterior upright wall side 3220, and marginal edge 33. Protective holder 30 may be made of any suitable material, but preferably it is made from plastic or aluminum alloy that is capable of being shaped.

Bottom wall 31 may include bottom opening 3150 that is of a size sufficient for consumer 5 to insert a digit in the opening to engage chemiluminescent illuminating base assembly 10 by applying pressure 9 on illuminating base portion 20. Consumer 5 may also apply pressure 9 on illuminating base portion 20 by using an object.

In one embodiment, bottom wall 31 is disposed without bottom opening 3150. In that instance, consumer 5 engages chemiluminescent illuminating base assembly 10 by applying pressure 9 through the protective holder 30 onto illuminating base portion 20. This may be facilitated by including in protective holder 30 an engaging pin or other pressure transfer device.

In one embodiment, illuminating base portion 20 is supported by a support formed by shaping bottom wall 31.

In one embodiment, substantially upright wall 32 is tapered to the bottom of chemiluminescent illuminating base assembly 10 to effect a desired styling.

In one embodiment, edge 33 has been styled by crimping it in an attractive fashion. It would similarly be possible that edge 33 can be irregular so that the height of upright wall 32 varies thus creating an aggressive styling for protective holder 30 and the chemiluminescent illuminating base assembly 10.

In one embodiment, coloring and/or a design has been applied to exterior upright wall side 3220 of the protective holder 30. The coloring or design may also be applied to other surface of protective holder 30.

In another embodiment, the entire protective holder 30 has been stylized to effect a desired appeal.

Chemiluminescent illuminating base 10 may be secured to product container 12 by one or more methods, means and/or devices so that the chemiluminescent illuminating base portion 10 is substantially secured to allow for the elements of chemiluminescent illuminating base assembly 1 to be handled, transported, sold, used, and/or discarded as one unit. Methods, means and/or devices utilized may be crimping and/or nesting a portion of chemiluminescent illuminating base 10, and/or by using interlocking mechanisms, strip adhesive, a spreadable glue, or any other type of affixing agents. These may only engage a part of the bottom surface Other means and/or devices may also be known.

With reference to FIGS. 3 and 4, a preferable embodiment using an adhesive is illustrated. Disposed on top wall 24 is adhesive 41. Adhesive 41 affixes illuminating base portion 20 to the bottom of product container 12. With respect to FIG. 3, adhesive 42 is disposed between interior upright wall 3210 and the periphery of product container 12. Adhesive 42 secures chemiluminescent illuminating base 10 to container 12. Adhesive 43 is disposed between interior bottom wall side 3110 and bottom wall 23 of illuminating base portion 20. Adhesive 43 secure illuminating base portion to the interior bottom wall side 3110.

What is claimed is:

1. An assembly comprising:

a product container having a bottom surface and at least one side surface;

a chemiluminescent illuminating base comprising an illuminating base portion substantially supporting the product container and having a top wall at least partially opposed to the bottom surface of the product container;

a bottom wall capable of transmitting an engaging pressure;

a chemiluminescent illuminating device disposed between the top and bottom walls and operative by the application of the engaging pressure; and at least one substantially upright wall connecting the top and bottom walls, and enclosing the chemiluminescent illuminating device; and being secured at the top wall of the illuminating base portion to the bottom surface of the product container.

2. The assembly of claim 1, further comprising an adhesive to secure at least part of the top wall of the illuminating base portion to the bottom surface of the product container.

3. The assembly of claim 1, further comprising:

a holder portion having the illuminating base portion disposed therein and having at least one substantially upright wall having a marginal edge disposed against the side surface of the product container, and a bottom wall, being substantially axially opposed to the upright wall; and being secured at the marginal edge against the side surface of the product container.

4. The assembly of claim 2, further comprising:

a holder portion having the illuminating base portion disposed therein and having at least one substantially upright wall having a marginal edge disposed against the side surface of the product container, and a bottom wall, being substantially axially opposed to the upright wall; and being secured at the marginal edge against the side surface of the product container.

5. The assembly of claim 3 wherein the substantially flat bottom further comprises a hole for inserting a digit or device.

6. The assembly of claim 4 wherein the substantially flat bottom further comprises a hole for inserting a digit or device.

7. The assembly of claim 3 further comprising an adhesive to secure at least partially the marginal edge against the side surface of the product container.

8. The assembly of claim 4 further comprising an adhesive to secure at least partially the marginal edge against the side surface of the product container.

9. The assembly of claim 3 further comprising an adhesive to secure at least partially the illuminating base portion to the holder portion.

10. The assembly of claim 4 further comprising an adhesive to secure at least partially the illuminating base portion to the holder portion.

11. A chemiluminescent illuminating base comprising:

an illuminating base portion substantially supporting the product container and having a top wall at least partially opposed to the bottom surface of the product container;

a bottom wall capable of transmitting an engaging pressure;

a chemiluminescent illuminating device disposed between the top and bottom walls and operative by the application of the engaging pressure; and at least one substantially upright wall connecting the top and bottom walls, and enclosing the chemiluminescent illuminating device; and being secured at the top wall of the illuminating base portion to the bottom surface of the product container.

12. A method of manufacturing an assembly, comprising:.

providing product container having a bottom surface and a side surface;

providing a chemiluminescent illuminating base further comprising the steps of providing an illuminating base portion substantially supporting the product container and comprising the steps of providing a top wall at least partially opposed to the bottom surface of the product container;

providing a bottom wall capable of transmitting an engaging pressure;

disposing a chemiluminescent illuminating device between the top and bottom walls and being operative by the application of the engaging pressure; and providing at least one substantially upright wall connecting the top and bottom walls, and enclosing the chemiluminescent illuminating device; and securing the top wall of the illuminating base portion to the bottom surface of the product container.

13. The method of manufacturing an assembly of claim 12, further comprising:

providing a holder portion having the illuminating base portion disposed therein and having at least one substantially upright wall having a marginal edge disposed against the side surface of the product container, and a bottom wall, being substantially axially opposed to the upright wall; and securing the marginal edge against the side surface of the product container.

14. The method of manufacturing an assembly of claim 12 further comprising the step of providing an adhesive for securing the top wall of the illuminating base portion to the bottom surface of the product container.

15. The method of manufacturing an assembly of claim 13 further comprising the step of providing an adhesive for securing the top wall of the illuminating base portion to the bottom surface of the product container.

16. The method of manufacturing an assembly of claim 13 further comprising the step of providing an adhesive for securing the marginal edge against the side surface of the product container.

17. The method of manufacturing an assembly of claim 13 further comprising the step of providing an adhesive for securing the marginal edge against the side surface of the product container.

* * * * *